US006746211B2

(12) United States Patent
Kwon et al.

(10) Patent No.: US 6,746,211 B2
(45) Date of Patent: Jun. 8, 2004

(54) OPERATION CONTROL METHOD RESONANCE FREQUENCY OF RECIPROCATING COMPRESSOR

(75) Inventors: Kye-Si Kwon, Seoul (KR); Hyuk Lee, Siheung (KR); Hyung-Jin Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/201,736

(22) Filed: Jul. 24, 2002

(65) Prior Publication Data

US 2003/0175125 A1 Sep. 18, 2003

(30) Foreign Application Priority Data

Mar. 16, 2002 (KR) ..... 2002-14326

(51) Int. Cl.[7] ..... F04B 49/10

(52) U.S. Cl. ..... 417/44.11; 417/53; 417/416; 417/417; 318/607; 318/606; 318/433

(58) Field of Search ..... 417/53, 44.11, 417/416, 417; 318/606, 607, 629, 430, 431, 432, 433, 434

(56) References Cited

U.S. PATENT DOCUMENTS 3,855,515 A * 12/1974 Hutchins, Jr. ..... 318/685
4,971,522 A * 11/1990 Butlin ..... 417/18
5,020,125 A * 5/1991 Losic et al. ..... 388/811
5,350,992 A * 9/1994 Colter ..... 318/807
5,808,436 A * 9/1998 Choi et al. ..... 318/603
5,883,490 A * 3/1999 Moreira ..... 318/807
6,051,952 A * 4/2000 Moreira et al. ..... 318/738
6,515,444 B1 * 2/2003 Jahkonen et al. ..... 318/629
6,565,327 B2 * 5/2003 Yoo et al. ..... 417/44.1
6,597,146 B1 * 7/2003 Rehm et al. ..... 318/632

FOREIGN PATENT DOCUMENTS

JP 61052190 A * 3/1986 ..... H02P/7/628
JP 62247776 A * 10/1987 ..... H02P/1/52
JP 02250692 A * 10/1990 ..... H02P/6/02

* cited by examiner

*Primary Examiner*—Justine R. Yu
*Assistant Examiner*—Emmanuel Sayoc
(74) *Attorney, Agent, or Firm*—Birch, Stewart, Kolasch & Birch, LLP

(57) ABSTRACT

An operation control method of a reciprocating compressor is disclosed in which, in case that a motor is overloaded, an operation frequency is increased to render magnetic fluxes of a magnet and an input current are mutually offset, so that a reciprocating compressor can be stably driven even in case of the overload. For this purpose, while the reciprocating compressor using an inverter is operated at a rated frequency, a current load of the motor is measured and the measured load is compared with a pre-set reference load. Upon comparison, if the measured load is greater than the reference load, it is determined as an overload and the operation frequency is increased by as much as a certain value higher than an oscillation frequency, for performing an overload operation. In order to compensate a stroke reduction generated as the operaiton frequency is increased by as much the certain value, the voltage applied to the motor is increased by as much as a certain level according to the increased operation frequency, thereby performing an overload operation.

10 Claims, 7 Drawing Sheets

OPERATION CONTROL METHOD RESONANCE FREQUENCY OF RECIPROCATING COMPRESSOR

BACKGROUND OF THE INVENTION

1. Field of the Invention

The present invention relates to a reciprocating compressor, and more particularly, to an operation control method of a reciprocating compressor that is capable of stably driving a compressor when a motor is overloaded.

2. Description of the Background Art

In general, a reciprocating compressor is a device that variably controls a cooling capacity discharged therefrom by varying a compression ratio according to a stroke voltage applied thereto.

The general reciprocating compressor will now be described with reference to FIG. 1.

FIG. 1 is a block diagram of the construction of an operation control apparatus of the general reciprocating compressor.

As shown in FIG. 1, an operation control apparatus of the general reciprocating compressor includes: a reciprocating compressor (R.COMP) 12 for receiving a stroke voltage provided to an internal motor (not shown) according to a stroke reference value set by a user to control a vertical movement of an internal piston (not shown); a voltage detecting unit 30 for detecting a voltage applied to the reciprocating compressor 12 as the stroke is varied; a current detecting unit 20 for detecting a current applied to the reciprocating compressor as the stroke is varied; a microcomputer 40 for calculating a stroke by using the voltage and the current detected from the voltage detecting unit 30 and the current detecting unit 20, comparing the calculated stroke value with the stroke reference value, and outputting a corresponding switching control signal; and an electric circuit unit 10 for switching on/off an AC power with a triac (Tr1) according to the switching control signal of the microcomputer 40 so as to control a size of the stroke voltage applied to the reciprocating compressor 12.

The operation of the operation control apparatus of the conventional reciprocating compressor constructed as described above will now be explained.

In the reciprocating compressor 12, a piston is vertically moved by a stroke voltage inputted from the motor (not shown) according to a stroke reference value set by a user, and accordingly, a stroke is varied to thereby control a cooling capacity.

The stroke signifies a distance that the piston is reciprocally moved in the reciprocating compressor 12.

A turn-on period of the triac (Tr1) of the electric circuit unit 10 is lengthened by the switching control signal of the microcomputer 40, and as the turn-on period is lengthened, a stroke is increased.

At this time, the voltage detecting unit 30 and the current detecting unit 20 detect a voltage and a current applied to the reciprocating compressor 12 and apply them to the microcomputer 40, respectively, The microcomputer 40 calculates a stroke by using the voltage and the current detected by the voltage detecting unit 30 and the current detecting unit 20, compares the calculated stroke with the stroke reference value, and outputs a corresponding switching control signal.

If the calculated stroke is smaller than the stroke reference value, the microcomputer 40 outputs a switching control signal to length the ON-period of the triac (Tr1) to thereby increase the stroke voltage applied to the reciprocating compressor 12.

If, however, the calculated stroke is greater than the stroke reference value, the microcomputer 40 outputs a switching control signal to shorten the ON-period of the triac (Tr1) to thereby reduce the stroke voltage applied to the reciprocating compressor 12.

As for the motor (not shown) installed in the reciprocating compressor 12, a coil is evenly wound thereon at a certain coil winding ratio, so that when a current according to the stroke voltage is applied to the coil, a magnetic pole is generated at the electromagnet in the coil of the motor and a magnetic flux is generated at the coil.

The reciprocating compressor is mechanically resonated at a rated driving frequency.

For example, if a rated frequency of the reciprocating compressor is 60 Hz, a resonance frequency is designed to be also 60 Hz at a rated current.

In case of a rated load of the reciprocating compressor, the resonance frequency (a rated driving frequency) is obtained by the sum of an inertia force ($M\ddot{X}(t)$), a damping force ($c\dot{X}(t)$)and a restitution ($kX(t)$)of a spring.

$$f(t)=\alpha i(t)=M\ddot{x}(t)+c\dot{x}(t)+kx(t) \tag{1}$$

$$k=ks+kg \tag{2}$$

wherein f(t) is a force applied to the motor, $\alpha$ is a motor constant, I(t) is current, x(t) is displacement, 'M' is a moving mass, 'c' is a damping constant, 'k' is a spring constant, ks is a machine spring, and kg is a gas spring.

The spring constant (k) is a sum of the machine spring (ks) connected to a mass moving by the motor so as to adjust a resonance point of the reciprocating compressor and the gas spring (kg) varied depending on a load of the reciprocating compressor.

The displacement (x(t)) is a distance that the magnet is moved from the center of the coil.

By Laplace transforming equation (1), a relation between the current and the displacement of the reciprocating compressor can be obtained.

The reciprocating compressor is designed such that the resonance frequency and the driving frequency are the same with each other at a rated load.

Equation (1) can be expressed as the frequency domain as follows:

$$F(j\omega) = -M\omega^2 X(j\omega) + cj\omega X(j\omega) + kX(j\omega) \tag{3}$$

$$\frac{X(j\omega)}{F(j\omega)} = \frac{1}{-M\omega^2 + k + j\omega c} \tag{4}$$

$$f_n = \frac{1}{2\pi}\sqrt{\frac{k}{M}} \tag{5}$$

$$\omega = 2\pi f = \sqrt{\frac{k}{M}} \tag{6}$$

$$M\omega^2 = k \tag{7}$$

$$\frac{X(j\omega)}{F(j\omega)} = \frac{1}{j\omega c} = -j\frac{1}{c\omega} \tag{8}$$

wherein $\omega$ is a driving frequency (rad/s), 'f' is a driving frequency (Hz), 'j' is an imaginary number, and $f_n$ is a resonance frequency.

At this time, F(jω) is a value obtained by Fourier transforming f(t) of equation (q) and XO(jω) is a value obtained by Fourier transforming x(t).

By applying equation (5) related to the resonance frequency (rated driving frequency) of the reciprocating compressor to equation (4) related to the force and the displacement of the reciprocating compressor, a force and a displacement according to the resonance frequency of the reciprocating compressor can be obtained.

Thus, as shown in equation (8), a force and a displacement exhibits a 90° phase difference. In addition, since the force and the phase of current are the same, a magnetic flux of the core generated by the current shows 90° phase difference from the magnetic flux generated due to the displacement of the magnet.

This will now be described in detail with reference to FIG. 2.

FIG. 2 illustrates waveforms showing a relation between the current applied to the reciprocating compressor and a displacement in resonating at a rated load.

As shown in FIG. 2, when current is applied to the motor in resonating at a rated load, current is applied to the coil of the motor and a magnetic flux is generated at the coil in a direction that the current is applied.

As indicated by 'a' shown in FIG. 2, when current is inputted counterclockwise, N pole is generated from the right side of the coil while S pole is generated from the left side of the coil. At this time, a magnetic flux generated by the current is maximized. When the magnetic flux by the current is maximized, the magnetic flux by the current and the magnetic flux according to the displacement of the magnet have the 90° phase difference, so that the magnet is positioned at the center of the coil and the magnetic flux of the core by the magnet is minimized.

Subsequently, as indicated by 'b' shown in FIG. 2, when the magnet is moved in one direction, the magnetic flux of the core by the current is minimized, so that the magnetic flux of the core by the current almost dies down and the magnetic flux of the core according to the magnet is maximized.

When the magnet is moved back to the center of the coil, the magnetic flux of the core by the current becomes great and the magnetic flux of the core bythe magnet is minimized (as indicated by 'c' in FIG. 2).

If the magnet is moved in the opposite direction again, the magnetic flux of the core by the current becomes small and the magnetic flux of the core bythe magnet also becomes small (as indicated by 'd' in FIG. 2).

The above operations are repeatedly performed, so that the magnetic flux of the core of the motor, that is, the magnetic flux of the core bythe current and the magnetic flux of the core bythe magnet are added to have 900 phase difference.

However, during the above operation, if the compressor is overloaded, the rigidity of the gas spring is increased and a natural frequency of the reciprocating compressor becomes higher than the driving frequency, and accordingly, the current will be easily saturated.

This will now be described in detail with reference to FIG. 3.

FIG. 3 illustrates waveforms showing a relation between an input current and a displacement in case of an overload in accordance with the conventional art.

In case that the motor is overloaded, that is, if a driving current is greater than by about 1.3 times than a rated current, the rigidity of the gas spring is increased, that is, for example, the natural frequency becomes 62 Hz when the driving frequency is 60 Hz, so that a resonance point is heightened.

That is, if the driving frequency is constant and a load is increased during the operation of the motor, the value of the gas spring constant (kg) among the value of the spring constant 'k' of equation (4) is increased.

If the value 'k' is increased, Mω2 of the driving frequency becomes smaller than 'k', so that the force and displacement of the reciprocating compressor have a phase close to 0°.

In other words, when the load value of the gas spring is increased, an input current is increased in order to constantly move the piston of the reciprocating compressor. Thus, as the input current is increased, the magnetic flux of the input current and the magnetic flux of the magnet have the same phase, and thus, the self-saturation becomes more severe.

In case of the overload as described above, the relation between the force and the displacement can be expressed by equation (8) as follows:

$$\frac{X(J\omega)}{F(J\omega)} \approx \frac{1}{k} \tag{9}$$

$$(\text{If } M\omega^2 < k,\ \ c < k)$$

Thus, as shown in FIG. 3, the phases of the force according to the input current and the displacement are almost the same each other. That is, the magnetic flux (displacementO generated at the core of the magnet and the magnetic flux of the core generated by the input current becomes in-phase.

As described above, in case of the overload, when the phase difference between the input current and the displacement of the magnet is 0°, the magnetic flux by the current and the magnetic flux by the magnet are added to make the saturation phenomenon of the core more serious.

If the core saturation phenomenon is severe, the reciprocating compressor fails to have a sufficient cooling capacity and the current rises excessively to cause a motor trouble.

Namely, in case of the overload, the rigidity according to the gas spring is increased and the resonance point is heightened. At this time, the input current is increased, and at the same time, the magnetic flux by the current and the magnetic flux by the magnet are operated in the same phase, so that a self-saturation become more severe.

Thus, due to the self-saturation of the motor, the inductance of the motor is reduced and current is suddenly increased to cause damage to the motor.

In an effort to solve the above problem, it is designed that the weight of the moving part, that is, the piston, is made increased, so that, in case of the overload, the phases of the magnetic fluxes bythe magnet and the current are not the same with each other.

This solution, however, has a problem that a resonance at the rated load and a resonance of the reciprocating compressor become different, causing a problem of degradation of efficiency at the rated.

SUMMARY OF THE INVENTION

Therefore, an object of the present invention is to provide an operation control method of a reciprocating compressor that is capable of being driven in case of an overload by heightening a driving frequency for driving a motor as high as a certain level higher than a rated operation frequency to offset the magnetic flux of the current and the magnetic flux of the magnet, thereby preventing a saturation phenomenon of a magnetic flux by current of a reciprocating compressor or a magnetic flux by a magnet.

To achieve these and other advantages and in accordance with the purpose of the present invention, as embodied and broadly described herein, there is provided a reciprocating compressor using an inverter including the steps of: measuring a current load of the motor while being operated at a rated frequency; comparing the measured load and a pre-set reference load; determining an overload if the measured load is greater than the reference load, increasing an operation frequency by as much as a certain value higher than an oscillation frequency, and performing an overload operation; and increasing a voltage applied to the motor by as much as a certain level according to the increased operation frequency and performing an overload operation, in order to compensate a stroke reduction generated as the operation frequency is increased to as high as the certain value.

The advantages in accordance with the present invention are embodied in an alternative embodiment, wherein there is provided an operation control method of a reciprocating compressor driven by an inverter comprising the steps of measuring a resonance frequency applied to a motor while the reciprocating motor is being operated at a rated frequency, comparing the measured resonance frequency with a pre-set reference resonance frequency, keeping operating the reciprocating compressor at the rated frequency if the measured resonance frequency is smaller than or the same as the reference resonance frequency, and determining an overload if the measured resonance frequency is greater than the reference resonance frequency and increasing the current operation frequency by as much as a certain level, for an overload operation.

The reference resonance frequency is set the same with the rated frequency in case of the rated load.

The overload is a value set by an experiment, for which a driving current value is greater by over 1.3 times (30%) than the current value at the rated load.

In case of the overload, the operation frequency is increased by a certain value higher than the resonance frequency, for the overload operation.

As for the operation frequency in case of the overload, a current is set greater by 1.3 times (30%) than the rated current, so that a phase difference between a magnetic flux generated by the input current and a magnet flux generated by the magnet is 180 degree.

In case of the overload, if the operation frequency is increased by a certain value, it is moved in the same direction as the pole generated in the coil of the motor.

If the operation frequency is increased by as much as a certain value, the current inputted to the motor and the magnetic flux of the magnet are moved in a direction that they are mutually offset.

In case of the overload operation, a voltage of the motor is increased by a certain level in order to compensate a stroke reduction according to the increase in the operation frequency.

The overload operating step comprises comparing the waveform of the input current applied to the motor with a reference current sine waveform, and determining an overload if a distortion occurs to the waveform, and increasing the current operation frequency by as much as a certain level, for an overload operation.

Alternatively, the overload operating step comprises comparing a power applied to the motor with a reference power, and determining an overload if the applied power is higher than the reference power, and increasing the current operation frequency by as much as a certain level, for an overload operation.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

A reciprocating compressor driven by an inverter of the present invention is featured in that when a load is increased more than a pre-set reference load during driving of the reciprocating compressor, a driving frequency for the current operation is increased as high as a certain level higher than a resonance frequency to move the reciprocating compressor, so that the magnetic flux by the current applied to the reciprocating compressor and the magnetic flux by the magnet are mutually offset, and thus, the reciprocating compressor can be driven even at the overload.

The operation and effect of the operation control method of a reciprocating compressor of the present invention will now be described in detail with reference to the accompanying drawings.

Figure 1:
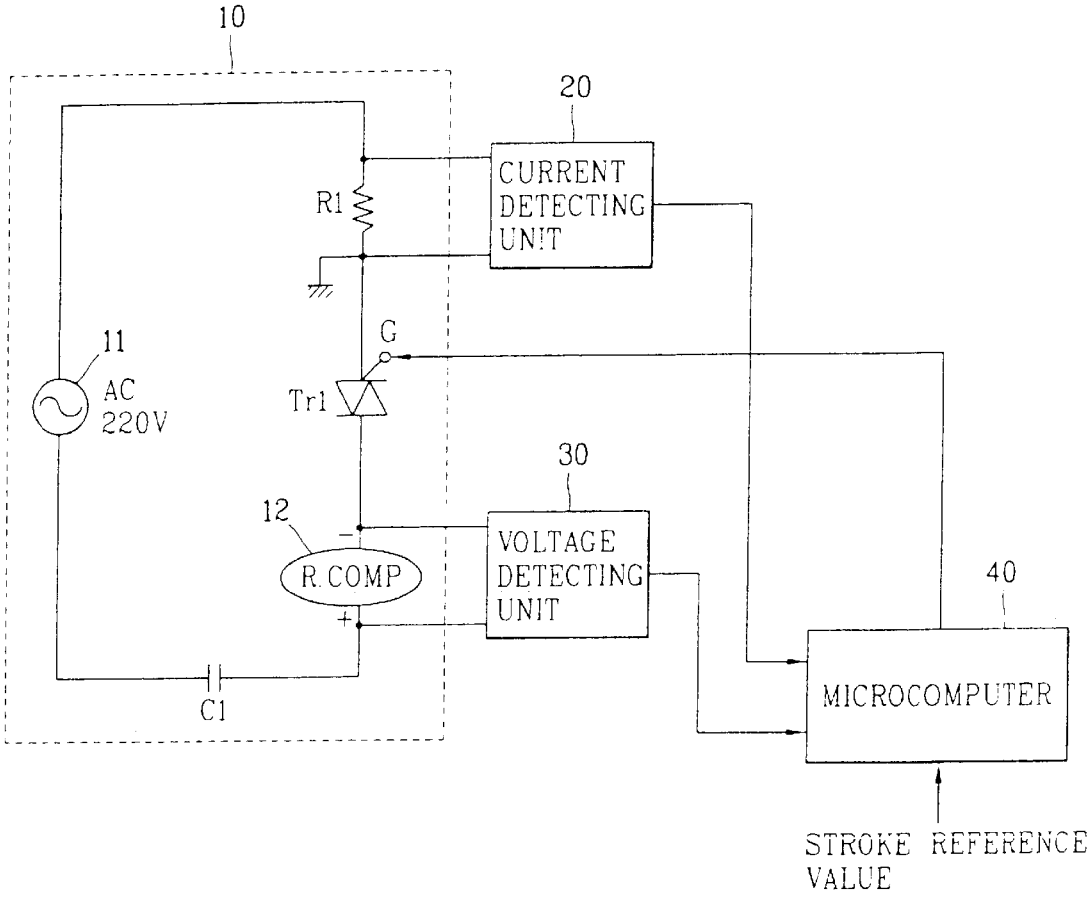
FIG. 1 PRIOR ART
FIG. 1 is a block diagram showing the construction of an operation control apparatus of a general reciprocating compressor.
Figure 2:
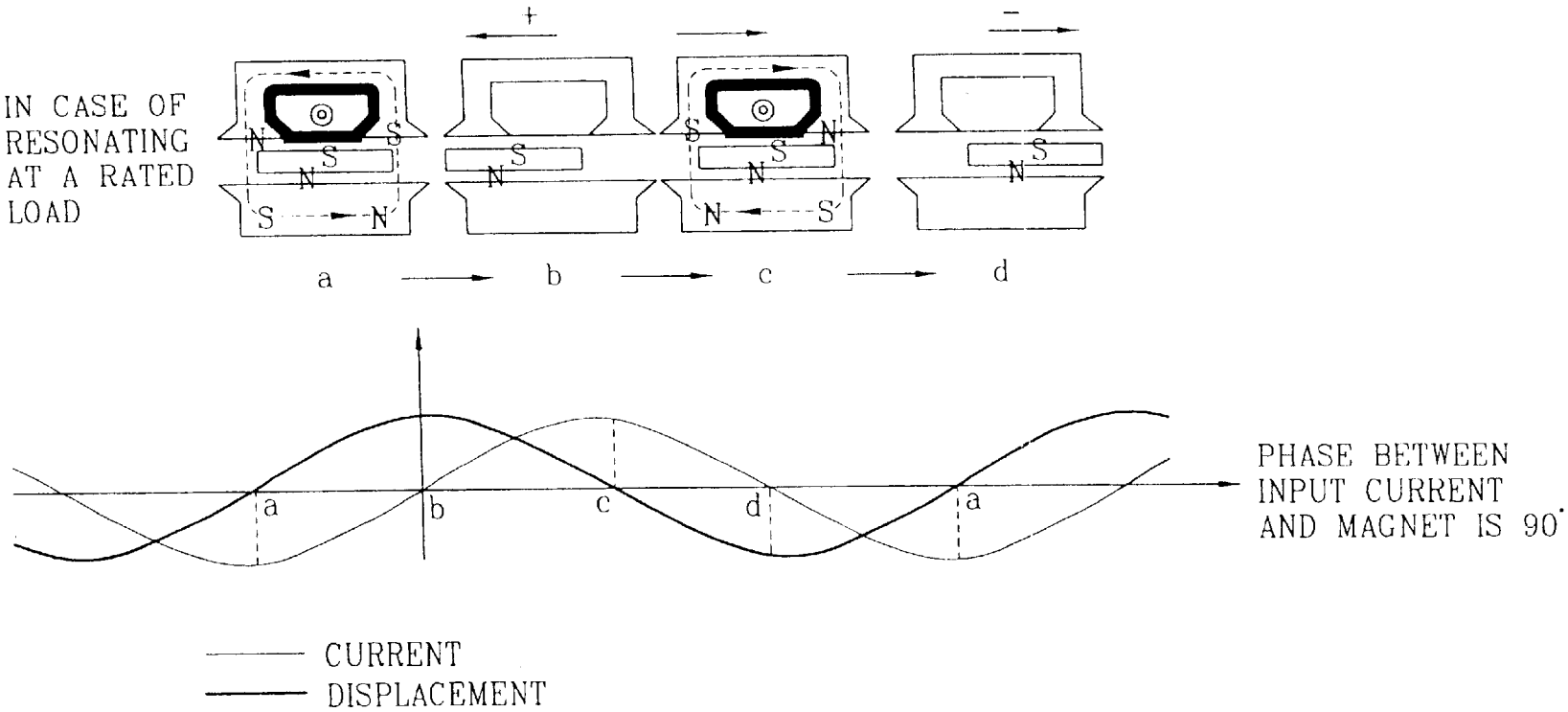
FIG. 2 PRIOR ART
FIG. 2 illustrates waveforms showing a relation between current and displacement applied to the reciprocating compressor in case of a rated load resonance in accordance with a conventional art.
Figure 3:
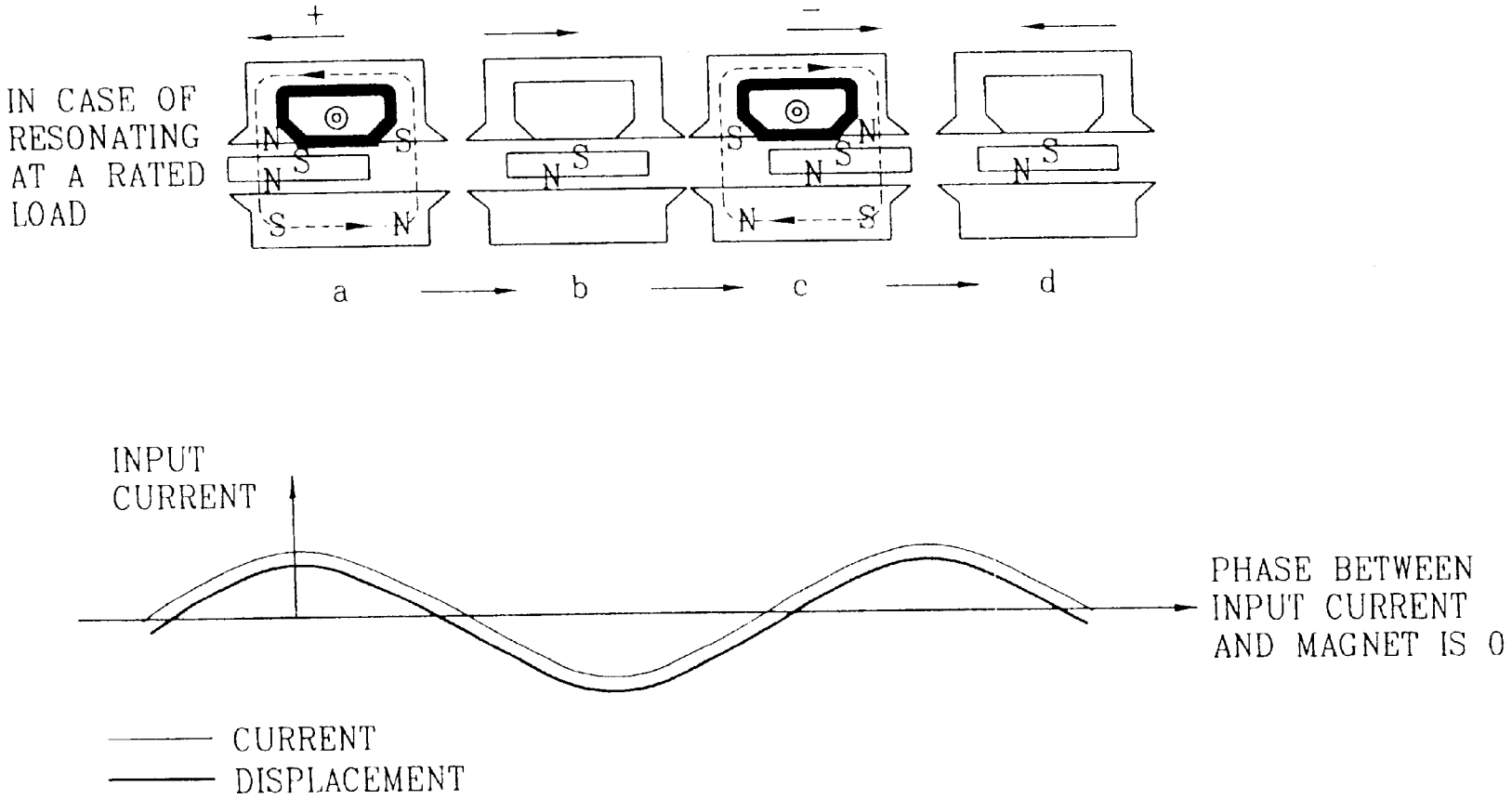
FIG. 3 PRIOR ART
FIG. 3 illustrates waveforms showing a relation between an input current and displacement in case of an overload in accordance with the conventional art.
Figure 4:
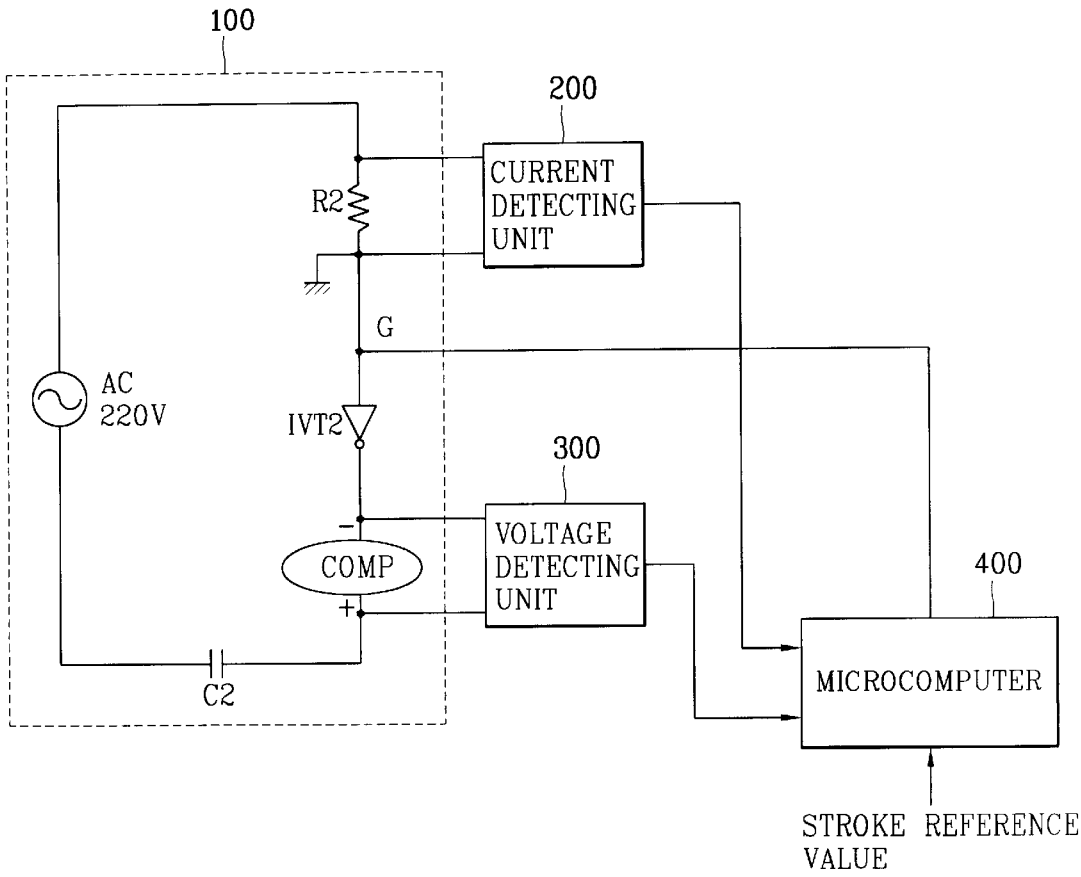
FIG. 4 is a block diagram showing the construction of an operation control apparatus of a reciprocating compressor in accordance with the present invention.

FIG. 4 is a block diagram showing the construction of an operation control apparatus of a reciprocating compressor in accordance with the present invention.

As shown in FIG. 4, the operation control apparatus of a reciprocating compressor includes: a reciprocating compressor (COMP) for receiving a stroke voltage provided to an internal motor (not shown) according to a stroke reference value set by a user to control a vertical movement of the internal piston (not shown); adjusting a resonance so that the piston can be operated at a pre-set resonance point (a driving frequency), and controlling a cooling capacity by varying a stroke according to the vertical movement of the piston; a voltage detecting unit 300 for detecting a voltage generated at the reciprocating compressor (COMP) as the stroke is varied; a current detecting unit 200 for detecting a current applied to the reciprocating compressor (COMP) as the stroke is varied; a microcomputer 400 for calculating a stroke by using the voltage and current respectively detected by the voltage detecting unit 300 and the current detecting unit 200, comparing the calculated stroke value with the stroke reference value; and outputting a corresponding operation frequency control signal by comparing a load and power of the reciprocating compressor (COMP) with a reference load and a reference power, and outputting a corresponding operation frequency control signal by calculating and comparing a period and waveform of the current applied to the reciprocating compressor; and an electric circuit unit 100 for controlling a conversion time point of a flowing direction of an applied AC current according to a control signal and the operation frequency control signal outputted from the microcomputer 400.

The motor of the reciprocating compressor will now be described with reference to FIG. 5.

Figure 5:
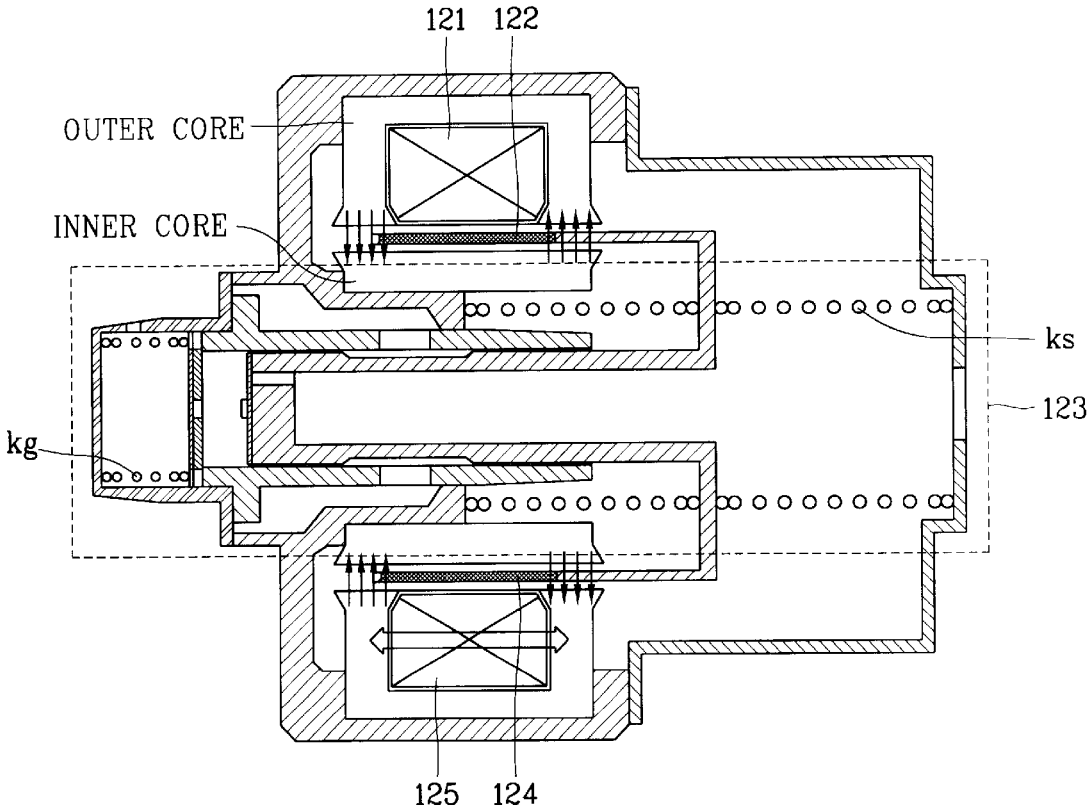
FIG. 5 shows a structure of a motor of the reciprocating compressor of FIG. 4.

FIG. 5 shows a structure of a motor of the reciprocating compressor of FIG. 4.

As shown in FIG. 5, the motor includes: coils 121 and 125 uniformly wound at a certain coil winding ratio; an outer core and an inner core for generating a magnetic flux when current is applied to the coils 121 and 125; fixing part consisting of permanent magnets 122 and 124; and a moving part 123 vertically moved owing to the magnetic flux generated when the magnets 122 and 124 are horiztonally moved.

Since the fixing part is vibrated under the influence of an applied current, the vibration is increased in case of overload and the resonance frequency is changed.

Thus, the resonance frequency in increased more than the operation frequency, so that if a high current is applied, the current of the motor and magnetic flux by the magnet are added only to make the saturation owing to the magnetic flux more severe. That is, a phase difference between the input current and the displacement of the magnet is 0°.

Therefore, in the present invention, in case of the overload, the operation frequency value is increased up to as much as a certain value so that the phase difference between the current and the displacement can be 180°.

The operation of the reciprocating compressor constructed as described above will now be explained with reference to FIGS. 6 and 7.

Figure 6:
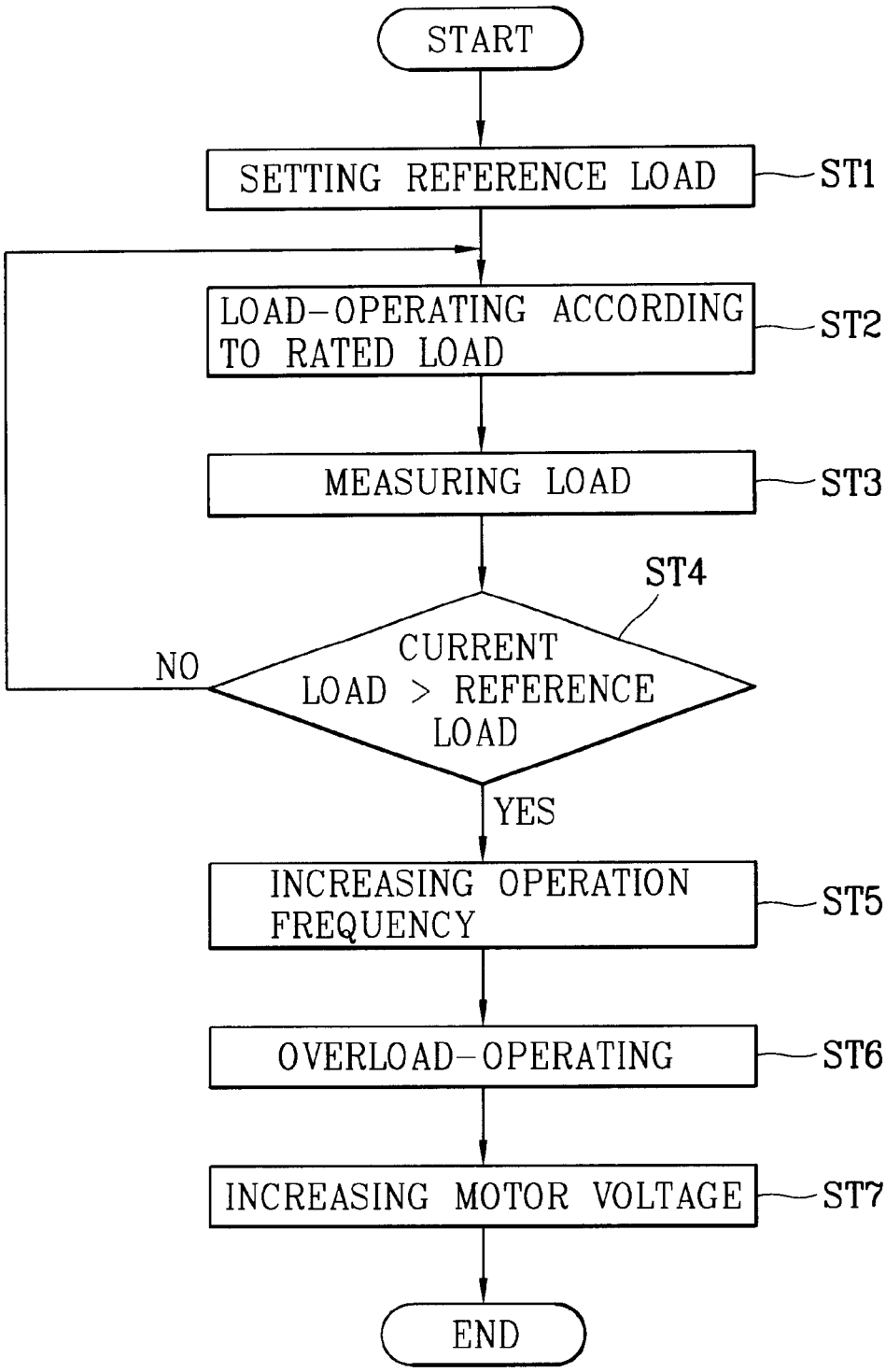
FIG. 6 is a flow chart of an operation control method of a reciprocating compressor in accordance with the present invention.
Figure 7:
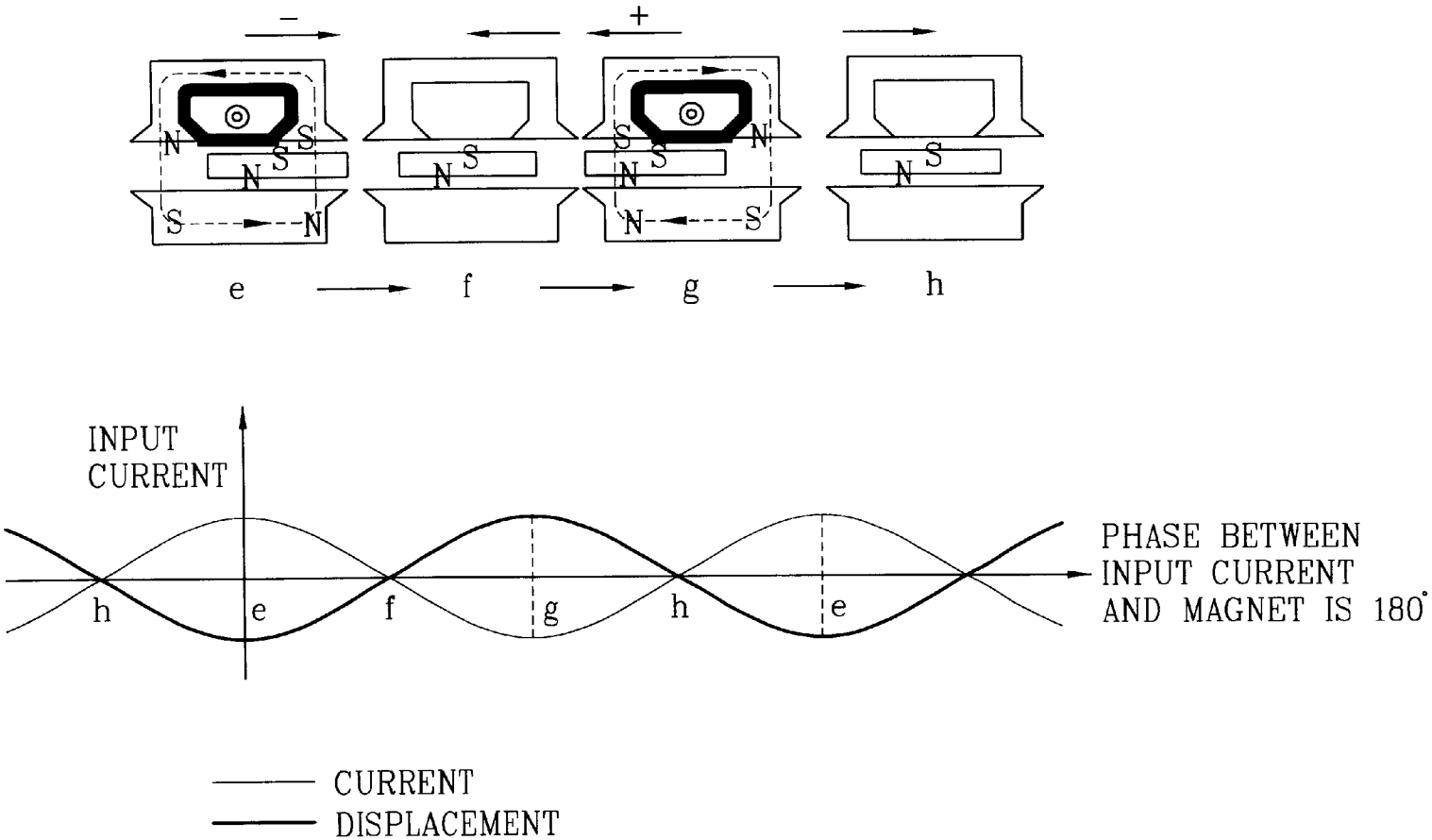
FIG. 7 illustrate waveforms showing a relation between an input current and displacement in case of an overload in accordance with the present invention.

FIG. 6 is a flow chart of an operation control method of a reciprocating compressor in accordance with the present invention, and FIG. 7 illustrate waveforms showing a relation between an input current and displacement in case of an overload in accordance with the present invention.

First, the reciprocating compressor is designed by setting a rated frequency of 60 Hz and a reference load (step ST1).

When current is applied to the thusly designed reciprocating compressor, the reciprocating compressor (COMP) operates at an operation frequency according to the rated load (ST2), measures a position of the motor, a rotation speed and a current load (ST3) and applies them to the microcomputer 400.

Then, the microcomputer 400 compares the measured load and the reference load, and if the measured load is smaller than or the same as the reference load (ST4), the microcomputer 400 keeps outputting an operation frequency for a load operation according to the rated load, that is, a rated frequency control signal, to the electric circuit unit 100.

The internal inverter (INT 2) of the electric circuit unit 100 controls a conversion time point of a flowing direction of an inputted sine wave AC power according to the inputted operation frequency control signal to control the period of the sine wave AC power, so as to thereby control the size of the power inputted to the motor.

The motor keeps making the load operation according to the rated load according to the outputted operation frequency control signal (ST2).

The reference load is previously set as a load of a current value higher by a certain level than the current value at the time of the rated load. According to an experiment, the reference load is set as a load of the current value higher by 1.3 times by the current value at the time of the rated load.

Upon comparison, if the measured load is greater than the reference load (ST4), the microcomputer 400 determines it as an overload, and applies a driving frequency control signal for increasing the current operation frequency by as much as a certain level to the motor (ST5).

The motor is overload-operated according to the applied driving frequency control signal (ST6).

For example, in case of an operation frequency with a natural frequency of 60 Hz, if its resonance frequency is changed from 60 Hz to 62 Hz due to an overload, the microcomputer 400 increases the operation frequency up to 67 Hz, 5 Hz higher than the increased resonance frequency and overload-operates the motor.

At this time, against the force of the motor, the displacement has approximately 180 degree phase difference, which can be expressed by equations (1) and (2) by using a motion equation of Newton as follows:

$$\frac{X(j\omega)}{F(j\omega)} = \frac{1}{-M\omega^2 + k + j\omega c} \approx \frac{1}{-M\omega^2 + j\omega c} \tag{1}$$

$$\omega_n = 2\pi f_n = \sqrt{\frac{k}{M}} \tag{2}$$

wherein F(jω) is a force applied to the motor, X(jω)) is a displacement, 'M' is a moving mass, 'c' is a damping constant, 'k' is a spring constant, ω is a driving frequency (rad/sec), $\omega_n$ is a resonance frequency, and 'j' is an imaginary number.

In this respect, F(jω) and X(jω) are obtained by representing the motion equation of Newton as a frequency domain and then Fourier-transferring it. The resonance frequency ($\omega_n$) is increased in proportion to the increase value of the spring constant (k).

In the case of overload, when the operation frequency is increased by about 5 Hz, higher than the resonance frequency, the value of the spring constant (k) is increased and the driving frequency (ω) is also increased. In this respect, however, since the driving frequency (ω) is more increased than the spring constant (k), the value of $M\omega^2$ of equation (2) becomes greater than the value 'k'.

Accordingly, assuming that the damping coefficient (C) is smaller than $M\omega^2$, the force and displacement of the reciprocating compressor are approximately in inverse proportion to the value of $-M\omega^2$.

This can be expressed by equation (3)

$$\frac{X(j\omega)}{F(j\omega)} \approx -\frac{1}{M\omega^2} \tag{3}$$

As shown in equation (3), about 180 degree phase difference occurs between the input current and the displacement.

Namely, as shown by 'e' in FIG. 7, when current is applied to the coil 120 of the motor counterclockwise (anode current), the magnet 220 is moved in the same direction as the pole of the magnetic flux generated at the coil 120 of the coil, that is, in the direction that the magnetic fluxes are mutually offset.

Subsequently, as shown by 'f' in FIG. 7, when the input current becomes '0', that is, at the time point where the flowing direction of the current is changed, the magnet is moved toward the center of the coil 120 of the motor. Thus, when the size of the magnetic flux by the current is minimized, the size of the magnetic flux by the magnet 122 is also minimized.

When the current is applied to the coil 120 of the motor clockwise (cathode current), the magnet 122 is moved in the same direction as the pole of the magnetic flux generated at the coil 120 of the motor, the opposite direction that the magnet 122 was previously moved. Thus, the magnetic fluxes are mutually offset (as shown by 'g' in FIG. 7).

In other words, the magnet 122 is moved in the direction that the magnetic flux of the core generated by the current and the magnetic flux generated by the displacement of the magnet become the same pole and mutually offset. Accordingly, the phase difference between the magnetic flux by the input current and the magnetic flux by the magnet is 180 degree.

When the magnetic flux by the input current and the magnetic flux by the magnet are mutually offset, a current saturation phenomenon according to the magnetic flux by the current and the magnetic flux by the magnet does not occur, so that the reciprocating compressor can stably operate without a saturation in the motor even in case of overload.

At this time, for the case of overload of the motor, the increase value of the operation frequency is an experiment value according to conditions of each motor, for which a value for rendering the phase difference between the current and the magnetic flux to be approximately 180 degree is previously set greater by 1.3 times (30%) than a rated current of each other in designing a motor.

However, in case of the overload operation of the reciprocating compressor, if the operation frequency is increased, a stroke applied to the reciprocating compressor can be a bit reduced according to the increase in the operation frequency.

In order to compensate it, if the operation frequency is increased by as much as a certain value, the microcomputer 400 increases the voltage applied to the motor by as much as a certain level (ST7).

In other words, in the reciprocating compressor driven by an inverter in accordance with the present invention, when an overload of the motor is detected, the current operation frequency is increased by as much as a pre-set value for an overload operation so that the magnetic fluxes by the input current and the magnet can be mutually offset.

At this time, the stroke may be a bit reduced according to the increase of the frequency by as much as an arbitrary value. Thus, in order to compensate it, a the voltage is rendered to be a bit increased.

In addition, the microcomputer 400 checks a current waveform applied to the reciprocating compressor, and if the waveform of the current is not a sine wave and has been severely distorted, the microcomputer 400 determines that it is overloaded (ST4).

Determining it to be the overload, the microcomputer 400 increases the operation frequency by a certain level higher than the oscillation frequency and applies it to the motor (ST5), for an overload operation (ST6).

In addition, the microcomputer 400 keeps comparing the power applied to the motor with a pre-set power as well as compares the load applied to the motor and the current waveform.

Upon comparison, if the measured power is higher than the reference power (ST4), it is determined to be an overload, so that the microcomputer 400 increases the operation frequency by a certain level (ST5) and overload-drives the motor (ST6).

As so far described, the operation control method of a reciprocating compressor of the present invention has many advantages.

That is, for example, first, an overload operation of a reciprocating compressor is determined, and if so, the operation frequency is increased to offset the magnetic fluxes of the magnet and the input current. Thus, the motor can be prevented from damaging in case of the overload.

Secondly, since the magnetic fluxes of the magnet and the input current are mutually offset and the saturation phenomenon according to the current dies down, no overcurrent is applied, and thus, a power consumption can be reduced.

Lastly, the phase difference between the input current and the displacement becomes 180 degree in order to prevent a saturation, and in case of controlling the reciprocating compressor by performing a sensorless displacement estimation of the stroke or the like, a phenomenon that the motor constant is rapidly dropped due to the saturation can be restrained. Accordingly, the motor will not malfunction, and thus, its efficiency can be maximized.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. An operation control method of a reciprocating compressor driven by an inverter, the method comprising the steps of:

measuring a resonance frequency of a motor of the reciprocating compressor while the reciprocating compressor is being operated at a rated frequency;

comparing the measured resonance frequency with a pre-set reference resonance frequency;

keeping operating the reciprocating compressor at the rated frequency if the measured resonance frequency is smaller than or the same as the reference resonance frequency; and determining an overload condition if the measured resonance frequency is greater than the reference resonance frequency and increasing the current operation frequency by as much as a certain level, for an overload operation.

2. The method of claim 1, wherein the reference resonance frequency is set the same with the rated frequency in case of the rated load.

3. The method of claim 2, wherein the overload is a value set by an experiment, for which a driving current value is greater by over 1.3 times (30%) than the current value at the rated load.

4. The method of claim 1, wherein, in case of the overload, the operation frequency is in-creased increased by a certain value higher than the resonance frequency, for the overload operation.

5. The method of claim 4, wherein, as for the operation frequency in case of the overload, a current is set greater by 1.3 times (30%) than the rated current, so that a phase difference between a magnetic flux generated by the input current and a magnet flux generated by the magnet is 180 degree.

6. The method of claim 4, wherein, in case of the overload, if the operation frequency is increased by a certain value, it is moved in the same direction as the pole generated in the coil of the motor.

7. The method of claim 4, wherein, if the operation frequency is increased by as much as a certain value, the current inputted to the motor and the magnetic flux of the magnet are moved in a direction that they are mutually offset.

8. The method of claim 1, wherein, in case of the overload operation, a voltage of the motor is increased by a certain level in order to compensate a stroke reduction according to the increase in the operation frequency.

9. The method of claim 1, wherein the overload operating step comprises:

comparing the waveform of the input current applied to the motor with a reference current sine waveform; and determining an overload if a distortion occurs to the waveform, and increasing the current operation frequency by as much as a certain level, for an overload operation.

10. The method of claim 1, wherein the overload operating step comprises:

comparing a power applied to the motor with a reference power; and determining an overload if the applied power is higher than the reference power, and increasing the current operation frequency by as much as a certain level, for an overload operation.

* * * * *